US008557134B2

(12) United States Patent
Bosar et al.

(10) Patent No.: US 8,557,134 B2
(45) Date of Patent: Oct. 15, 2013

(54) ACCURATELY MONITORED CMP RECYCLING

(75) Inventors: Shaun C. Bosar, Kyle, TX (US); Martin Boehm, Wilsonville, OR (US); Robert Edward Johnston, Heath, TX (US)

(73) Assignee: Environmental Process Solutions, Inc., Rockwall, TX (US)

( * ) Notice: Subject to any disclaimer, the term of this patent is extended or adjusted under 35 U.S.C. 154(b) by 203 days.

(21) Appl. No.: 13/010,051

(22) Filed: Jan. 20, 2011

(65) Prior Publication Data

US 2011/0180512 A1 Jul. 28, 2011

Related U.S. Application Data

(60) Provisional application No. 61/299,193, filed on Jan. 28, 2010.

(51) Int. Cl.
*B44C 1/22* (2006.01)
*C23F 1/00* (2006.01)

(52) U.S. Cl.
USPC ..... 216/93; 216/88; 216/89; 438/692; 438/693; 451/44; 451/54

(58) Field of Classification Search
USPC ..... 438/692, 693; 216/84, 88, 93; 451/44, 451/54
See application file for complete search history.

(56) References Cited

U.S. PATENT DOCUMENTS 4,059,929 A 11/1977 Bishop
5,575,705 A 11/1996 Yam et al.
5,664,990 A 9/1997 Adams et al.
5,755,614 A * 5/1998 Adams et al. ..... 451/60
5,791,970 A 8/1998 Yueh
5,846,398 A 12/1998 Carpio
5,855,792 A 1/1999 Adams et al.
6,048,256 A 4/2000 Obeng et al.
6,106,728 A 8/2000 Iida et al.
6,126,531 A 10/2000 Iida et al.

(Continued)

FOREIGN PATENT DOCUMENTS

JP 10-118899 12/1998

OTHER PUBLICATIONS

Dhawan, Gil, "Ultrafiltration"; Applied Membranes Inc., www.appliedmembranes.com/about_ultrafiltration.htm; Aug. 24, 2009, 6 pages.

(Continued)

*Primary Examiner* — Shamim Ahmed
(74) *Attorney, Agent, or Firm* — John A. Fortkort; Fortkort & Houston P.C.

(57) ABSTRACT

A method is provided for reformulating a chemical mechanical planarization (CMP) slurry for use in conjunction with a CMP tool having an active cycle during which the tool is being used to planarize a substrate, and a rinse cycle during which the tool is being rinsed. The method comprises (a) receiving a feed stream from the CMP tool, at least a portion of the feed stream comprising abrasive particles disposed in a liquid medium; (b) during at least a portion of the rinse cycle, sending the feedstream received from the CMP tool to a first location; and (c) during at least a portion of the active cycle, sending the feedstream received from the CMP tool to a second location where the feedstream undergoes processing to reformulate the slurry.

39 Claims, 8 Drawing Sheets

(56) References Cited

U.S. PATENT DOCUMENTS

| | | | | |
|---|---|---|---|---|
| 6,183,352 | B1 | 2/2001 | Kurisawa | |
| 6,413,151 | B2 | 7/2002 | Mizuno et al. | |
| 6,527,969 | B1 * | 3/2003 | Tanoue et al. | 216/93 |
| 6,547,961 | B2 | 4/2003 | Uto et al. | |
| 6,595,830 | B1 | 7/2003 | Hewett et al. | |
| 6,799,136 | B2 | 9/2004 | Patel et al. | |
| 6,866,784 | B2 | 3/2005 | Chang et al. | |
| 7,059,943 | B2 | 6/2006 | Cann et al. | |
| 7,488,423 | B2 | 2/2009 | Wismer et al. | |
| 2001/0003700 | A1 | 6/2001 | Mizuno et al. | |
| 2007/0029260 | A1 | 2/2007 | Wismer et al. | |
| 2007/0221575 | A1 * | 9/2007 | Copeland et al. | 210/636 |
| 2008/0166958 | A1 | 7/2008 | Golden et al. | |
| 2008/0233724 | A1 | 9/2008 | Fang et al. | |
| 2009/0053981 | A1 | 2/2009 | Kozasa et al. | |

OTHER PUBLICATIONS

Kormin, Faridah, "Ultrafiltration Membrane"; www.scienceray.com/chemistry/ultrafiltration-membrane; May 31, 2009; 9 pages.
Hollow Fiber Membranes-Overview; Koch Membrane Systems; www.kochmembrane.com/prod_hf.html; Aug. 24, 2009; 3 pages.
Spiral Membranes—Overview; Koch Membrane Systems; www.kochmembrane.com/prod_spiral.html; Aug. 24, 2009; 3 pages.
Tubular Membranes—Overview; Koch Membrane Systems; www.kochmembrane.com/prod_tubular.html; Aug. 24, 2009; 3 pages.
Ultrafiltration-Filtration Overview, A KMS Leadership Category; Koch Membrane Systems; www.kochmembrane.com/sep_uf.html; Aug. 24, 2009; 4 pages.
Polyacrylonitrile Ultrafiltration Membrane Elements; Applied Membranes Inc.; www.appliedmembranes.com/polyacrylonitrile1.htm; Aug. 24, 2009; 4 pages.
Polyethersulfone Ultrafiltration UF Membrane Elements; Applied Membranes Inc.; www.appliedmembranes.com/polyethersulfone.htm; Aug. 24, 2009; 3 pages.
Polyvinylidine Fluoride Ultrafiltration Electrocoat Membranes; Applied Membranes Inc.; www.appliedmembranes.com/electrocoat_elements.htm; Aug. 24, 2009; 2 pages.
What is an Ultrafiltration Membrane; Pall Corporation; http://pall.com/laboratory_7041.asp; Aug. 24, 2009; 1 page.
Morao, A. et al.; "Postsynthesis modification of a cellulose acetate ultrafiltration membrane for applications in water and wastewater treatment"; Wiley InterScience; www3.interscience.wiley.com/journal/112143832/abstract; Aug. 24, 2009; 2 pages.
Gore-Tex; "Membrane Filter Socks"; W.L. Gore & Associates, Inc.; Aug. 2004; 2 pages.
Tubular Membrane Filter; www.alibaba.com/product-gs/239942384/Tubular_Membrane_Filter.html; Aug. 2009; 2 pages.
Applied Reflexion LK Oxide and Polysilicon CMP; Superior Planarization Uniformity and Repeatability for Dielectrics and Polysilicon; www.appliedmaterials.com; Jul. 2007; 2 pages.
Park, Jin-Goo et al.; "In-situ Recycle of Used Oxide Slurry for Production"; The Electrochemical Society, Inc.; Abs. 914, 204th Meeting; 2003; 1 page.
White paper; Applied Material / Mirra / (PCMP); Applied Materials Tool Template Rev 3; Jun. 29, 2005; 5 pages.
Solid State Technology; CMP slurries: A wild ride ahead; www.solid-state.com/display_article/883551/5/ARTCL/none/1/CMP-slurries:A-wild-rid-ahead; Aug. 24, 2009; 5 page.
Kiefer Tech Co., Ltd.; CMP Slurry Recycle Business; www.kiefer-tech.com/english/product/recy.html; Aug. 24, 2009; 2 pages.
Kim, Hyung-Joon et al.; "Physical and Chemical Characterization of Reused Oxide Chemical Mechanical Planarization Slurry"; Jpn. J. Appl. Phys.; vol. 40; 2001; pp. 1236-1239.
Viadero, Jr. Roger C. et al.; "Study of series resistances in high-shear rotary ultrafiltration"; Journal of Membrane Science 162; 1999; pp. 199-211.
Jin, Raymond R. et al.; Volume production proven advanced nanometer slurries for CMP applications, capable of recycling and extendable to larger Si wafer sizes and future IC technology nodes; Semicon China 2004; SEMI Technology Symposium; 5 pages.
Jenkins, Brian et al.; Solid State Technology; "The many options for managing CMP wastewater"; Jul. 2004; 7 pages.
Siemens Water Technologies; Membrane Microfiltration Systems (EF and EFC Series); www.siemens.com/water; 2006; 2 pages.

* cited by examiner

*- Prior Art -*

ACCURATELY MONITORED CMP RECYCLING

CROSS-REFERENCE TO RELATED APPLICATION

This application claims the benefit of U.S. Provisional Application No. 61/299,193, filed Jan. 28, 2010, having the same title, and having the same inventors, and which is incorporated herein by reference in its entirety.

FIELD OF THE DISCLOSURE

The present disclosure relates generally to chemical-mechanical polishing (CMP) slurries, and more particularly to systems and methods for recycling such slurries.

BACKGROUND OF THE DISCLOSURE

Chemical mechanical polishing (CMP) is a staple process of the semiconductor industry, and is frequently used subsequent to epitaxy, deposition, etching and other such processes to impart a smooth, planarized surface to a substrate. In a typical CMP process, an abrasive, corrosive chemical slurry is used in conjunction with a polishing pad to remove material from a wafer substrate. This process evens out any irregularities in the topography of the wafer surface, and provides a planarized surface which is more conducive to subsequent processing.

SUMMARY OF THE DISCLOSURE

Figure 1:
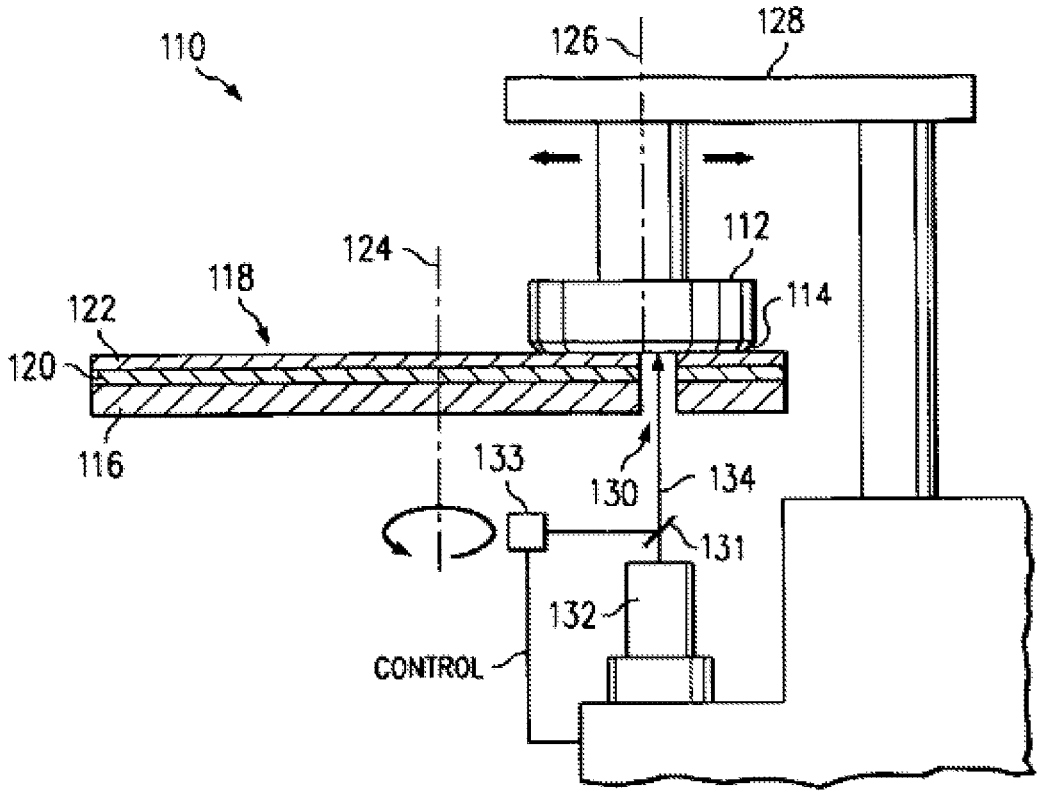
FIG. 1 is an illustration of a prior art CMP tool.

In one aspect, a method is provided for reformulating a chemical mechanical planarization (CMP) slurry for use in conjunction with a CMP tool having an active cycle during which the tool is being used to planarize a substrate, and a rinse cycle during which the tool is being rinsed. The method comprises (a) receiving a feed stream from the CMP tool, at least a portion of the feed stream comprising abrasive particles disposed in a liquid medium; (b) during at least a portion of the rinse cycle, sending the feedstream received from the CMP tool to a first location; and (c) during at least a portion of the active cycle, sending the feedstream received from the CMP tool to a second location where the feedstream undergoes processing to reformulate the slurry.

In another aspect, a method for recycling a CMP slurry is provided. The method comprises (a) using a slurry in a chemical mechanical planarization (CMP) process at a semiconductor processing facility, said slurry comprising abrasive particles disposed in a liquid medium; and (b) recirculating the used slurry through an ultra-filtration device at the semiconductor processing facility until the slurry attains a predetermined specific gravity, thereby producing a concentrated slurry.

In a further aspect, a method is provided for reformulating a chemical mechanical planarization (CMP) slurry. The method comprises (a) providing a feed stream from a CMP tool, said feed stream comprising abrasive particles disposed in a liquid medium; (b) sending the feedstream to a first location when the concentration of abrasive particles in the feedstream is below a threshold level k; and (c) sending the feedstream to a second location when the concentration of abrasive particles in the feedstream is above the threshold level k, where the feedstream undergoes processing at the second location to reformulate the slurry.

In a further aspect, a method is provided for reformulating a chemical mechanical planarization (CMP) slurry, comprising (a) providing a feed stream from a CMP tool, at least a portion of said feed stream comprising abrasive particles disposed in a liquid medium; (b) sending the feedstream to a first location during a first time interval, where the feedstream undergoes processing at the first location to reformulate the slurry; and (c) sending the feedstream to a second location during a second time interval. Preferably, the CMP tool conducts chemical mechanical planarization of at least one semiconductor substrate over a first time interval $T_1=\{t_0, t_1\}$, and conducts a rinsing cycle over a second time interval $T_2=\{t_2, t_3\}$, wherein the feedstream is sent to the first location during the time interval $t_0+a$ to $t_1+b$, wherein a, b>0, and is sent to the second location during the time interval $t_2+c$ to $t_3+d$, wherein c, d>0.

In yet another aspect, a method is provided for recycling CMP slurry. The method comprises (a) using a slurry in a chemical mechanical planarization (CMP) process at a semiconductor processing facility, said slurry comprising abrasive particles disposed in a liquid medium; and (b) recirculating the used slurry through an ultra-filtration device at the semiconductor processing facility until the slurry attains a predetermined specific gravity, thereby producing a concentrated slurry.

In still another aspect, systems are provided for implementing the aforementioned methods.

DETAILED DESCRIPTION

The cost of the abrasive slurry used in a CMP process represents a significant portion of the overhead for that process. Some of the abrasive particles in the slurry are degraded with each use so that they no longer provide the desired abrasive effect. Other particles in the slurry can undergo agglomeration after use to form larger particles. These larger particles are undesirable in that they can abrade a semiconductor substrate unevenly, thus creating unwanted gouges or scratches in the surface of the substrate.

The foregoing notwithstanding, most of the abrasive particles in a used CMP slurry are reusable, though it will frequently be necessary to add virgin slurry to the used slurry to account for particle degradation and removal. Hence, several methods have been developed in the art to recycle CMP slurries.

A typical method attempts to remove particles that fall outside of a desired particle distribution range. This may result in the removal of slurry particles that are too small to be useful, and/or in the removal of agglomerates which would be harmful to a semiconductor substrate. It may also be necessary to perform other steps, such as pH adjustment, which may be necessary to reconstitute the slurry so that it has characteristics which are comparable to those of virgin slurries.

To date, however, the methods developed in the art for recycling slurries are both inefficient and costly. For example, some methods rely on transporting the used slurry (which might be partially reprocessed) from the site of use to a slurry reprocessing plant. These approaches consume considerable resources just in transporting the slurries. Other methods attempt to recycle the slurry on site. However, many of these methods are inefficient, or require large amounts of space to accommodate the recycling equipment. Such methods are not practical for use onsite (i.e., at the location of the CMP processing tool), where real estate is typically at a premium. There is thus a need in the art for a more efficient, and hence less expensive, process for recycling CMP slurries.

It has now been found that the foregoing needs may be met through systems and processes of the type disclosed herein which obtain an initially higher concentration (as compared to prior art processes) of abrasive particles in the used CMP slurry, prior to reconstituting the slurry for further use. This end may be accomplished, for example, by receiving a feed from a CMP tool at the CMP slurry recycling system only during times when the content of abrasive grit in the feed is relatively high, and by diverting the feed at other times (e.g., during times when the content of abrasive particles in the feed is relatively low, as during a portion of the tool rinse cycle). By contrast, typical CMP slurry recycling systems collect all of the feed from a CMP tool. By selectively diverting a portion of the feed in this manner, the systems and methodologies described herein may begin the slurry recycling process at a significantly higher initial concentration of abrasive particles. This improves the efficiency and reduces the size of the CMP recycling system, and also reduces the throughput time required to obtain the reconstituted slurry.

It has also been found that the foregoing needs may be met through systems and processes of the type disclosed herein which utilize an ultra-filtration device early on in the slurry recycling system to further increase the concentration of abrasive particles in the slurry. Again, this approach allows subsequent processing of the slurry to begin at a significantly higher initial concentration of abrasive particles, thus improving the efficiency and reducing the size of the CMP recycling system, and reducing the throughput time required to obtain the reconstituted slurry.

In some embodiments, the slurry may be recirculated multiple times through a loop comprising an ultra-filtration device while it is awaiting further processing, especially at the front end of the recycling process. This approach is advantageous in that it takes advantage of any downtime occasioned by downstream processing to achieve a further initial increase in the concentration of the slurry. Preferably, the ultra-filtration device is adapted to remove a portion of the liquid medium from the slurry during each pass through the device, while retaining the portion of the abrasive particle content which falls above the minimum targeted particle size. This portion of the process may include agglomerate removal and sanitization of the slurry as well.

Slurry recycling is preferably accomplished in accordance with the methods disclosed herein in three main phases: (1) selective effluent diversion at the CMP tool; (2) large particle filtration and biological filtering; (3) water or liquid separation and concentration of the slurry; and (4) slurry reconstitution. Each of these phases is described in greater detail below.

The devices and methodologies disclosed herein may be further appreciated in the context of a CMP tool, one particular, non-limiting embodiment of which is depicted in FIG. 1. The tool 110 depicted therein is a MIRRA® CMP polisher which is available commercially from Applied Materials, Santa Clara, Calif. This tool 110 may comprise a polish head 112. During polishing, the polish head 112 holds a semiconductor wafer 114 against a polishing platen 116 which is covered with a pad 118. The pad 118 has a backing layer 120 and pad material 122 which is used in conjunction with a chemical polishing slurry to polish the wafer. The pad material 122 may be, for example, an open cell foamed polyurethane or a sheet of polyurethane with a grooved surface.

During use, the pad material 122 is wetted with the chemical polishing slurry, and the platen 116 is rotated about a central axis 124. The polishing head 112 is also rotated about its axis 126 and is translated across the surface of the platen 116 by a translation arm 128. The polisher includes a laser 132 aimed at a light passing window 130 in the platen 116, pad 118 and covering 122 to the wafer 114. The laser 132 generates a signal which is passed through the window 130 and reflected off the wafer back through the window 130 and coupled through a splitter 131 to a light detector 133. The signal may be used, for example, to monitor oxide layer thickness during the CMP process.

In an actual implementation, there may be four such polish heads 112 and three such platens 116. While one head 112 is unloading and loading a wafer 114, the other three heads 112 are positioned over each of the three platens 116. A wafer 114 is polished partially on the first platen, then on the second platen, and buffed or polished on the third platen. The head 112 is moved from platen to platen as the wafer 114 is processed. In some embodiments, signals from all polish platens are 116 concatenated together. The rate at which the material is removed is a factor of the downward pressure on the wafer against the platen, the relative velocity between the platen and the wafer, and the wafer topography. During each period of the signal, a certain thickness of material is removed from the surface of the wafer.

Slurry recycling in accordance with the teachings herein preferably commences with diversion of used slurry from the CMP tool. The goal of the diversion phase is to selectively divert used slurry effluent from the CMP processing tool in a way that will increase the initial concentration of recovered slurry, thereby reducing the size and capital cost of the slurry recycling system. Preferably, this goal is accomplished by concentrating the slurry during the diversion phase. The manner in which concentration is effected may vary from one implementation of the methodology to the next and may depend, for example, on the particular CMP tool being utilized.

For example, in a MIRRA® CMP tool of the type described above, the existing tubing and manifold beneath the tool may be replaced with a three-way valve manifold system with flexible tubing and a rigid header. The valves in the manifold system may be pneumatically actuated by the same air signal that actuates the tool slurry pumps (although this signal will typically need to be manipulated by an accessory apparatus such as, for example, a time delay), and may be configured to produce concentrated effluent and waste water as the two outputs of the system. The wastewater may be routed to a drain or to a DI water reclamation station.

Figure 2:
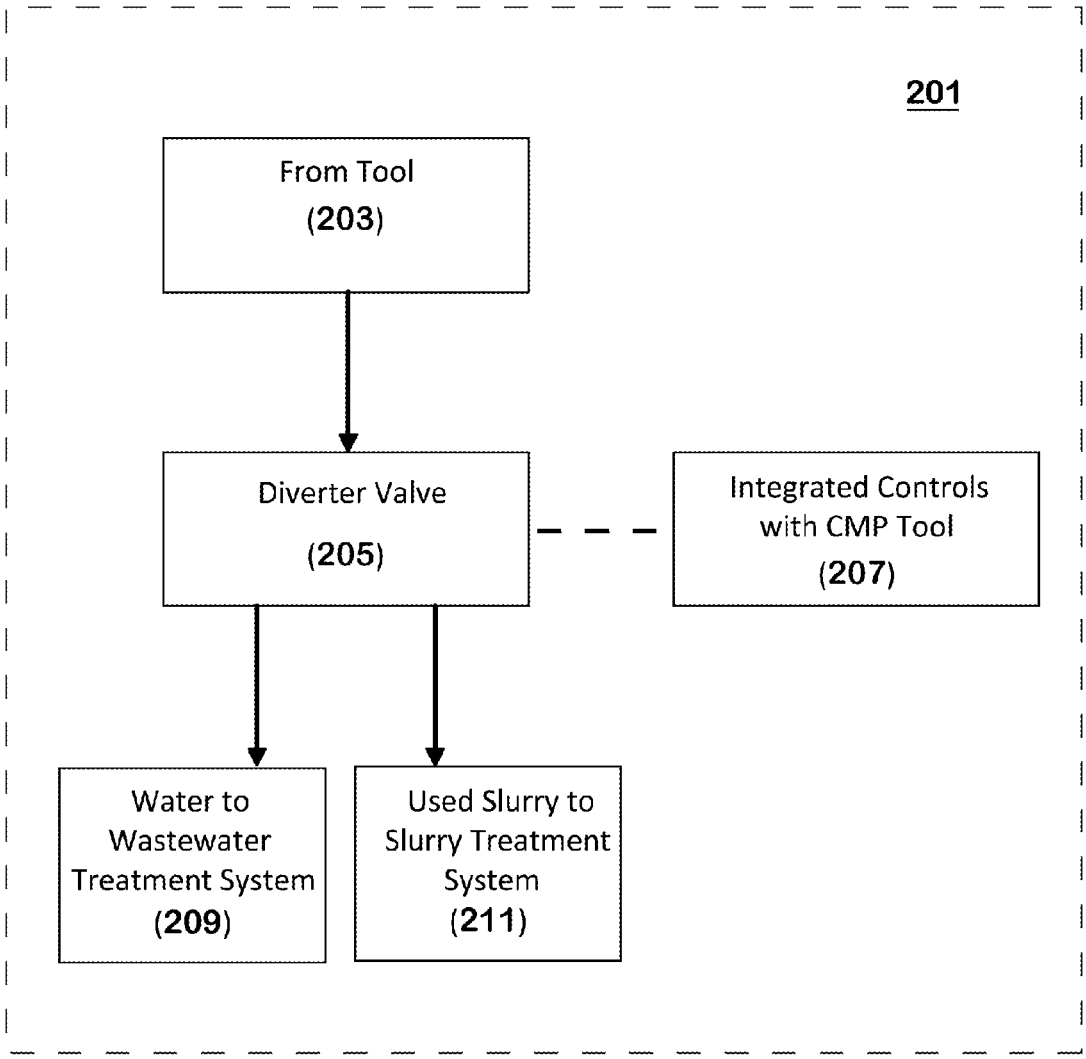
FIG. 2 is a flowchart depicting the interface between the process of FIG. 2 and a CMP processing tool.

The functionality of such a manifold system may be appreciated with respect to FIG. 2. In the setup 201 depicted therein, a flow of effluent from a CMP tool 203 is captured during both the slurry delivery and a portion of the rinse cycle by a diverter valve 205. The diverter valve has controls 207 which are integrated with the controls of the CMP tool. The diverter valve diverts a portion of the rinse water 209 to the wastewater treatment system of the facility in which the CMP tool is installed, and routes 211 the remaining (used and diluted) slurry (and preferably a portion of the rinse water containing abrasive grit) to the CMP slurry processing system described herein (see FIG. 3 below).

Preferably, diversion is implemented in accordance with the teachings herein to ensure that the capture of effluent occurs only when slurry is flowing, and during a portion of the subsequent rinse cycle (preferably the portion of the rinse cycle when the rinse water will contain a substantial content of abrasive particles). At all other times, the slurry content in the wastewater is typically very small, and consequently, diversion of the wastewater stream is not necessary, since it may be safely processed during those periods by the wastewater treatment system of the facility in which the CMP tool is installed.

Various means may be used to determine when diversion is appropriate. For example, diversion may be timed with a delay to occur over an interval beginning shortly after active CMP processing begins, and terminating shortly after CMP processing terminates, to account for the delay in time required for the concentration of abrasive particles in the feed stream entering the slurry recycling system to change. Alternatively, diversion may be controlled by one or more sensors which use optical, chemical or physical properties of the feed to determine when the content of abrasive particles is high enough to warrant diversion.

Through the use of such selective diversion, a much higher initial concentration of slurry is achieved in the slurry reprocessing system (relative to the case that would exist if the entire wastewater stream were directed to the slurry reprocessing system), thereby greatly improving the efficiency of the slurry recycling process. By contrast, typical onsite slurry reprocessing systems proposed in the art do not utilize such selective diversion, and hence must typically process a much larger volume of effluent. Such systems are therefore less efficient and costlier to operate than the systems proposed herein.

Figure 3:
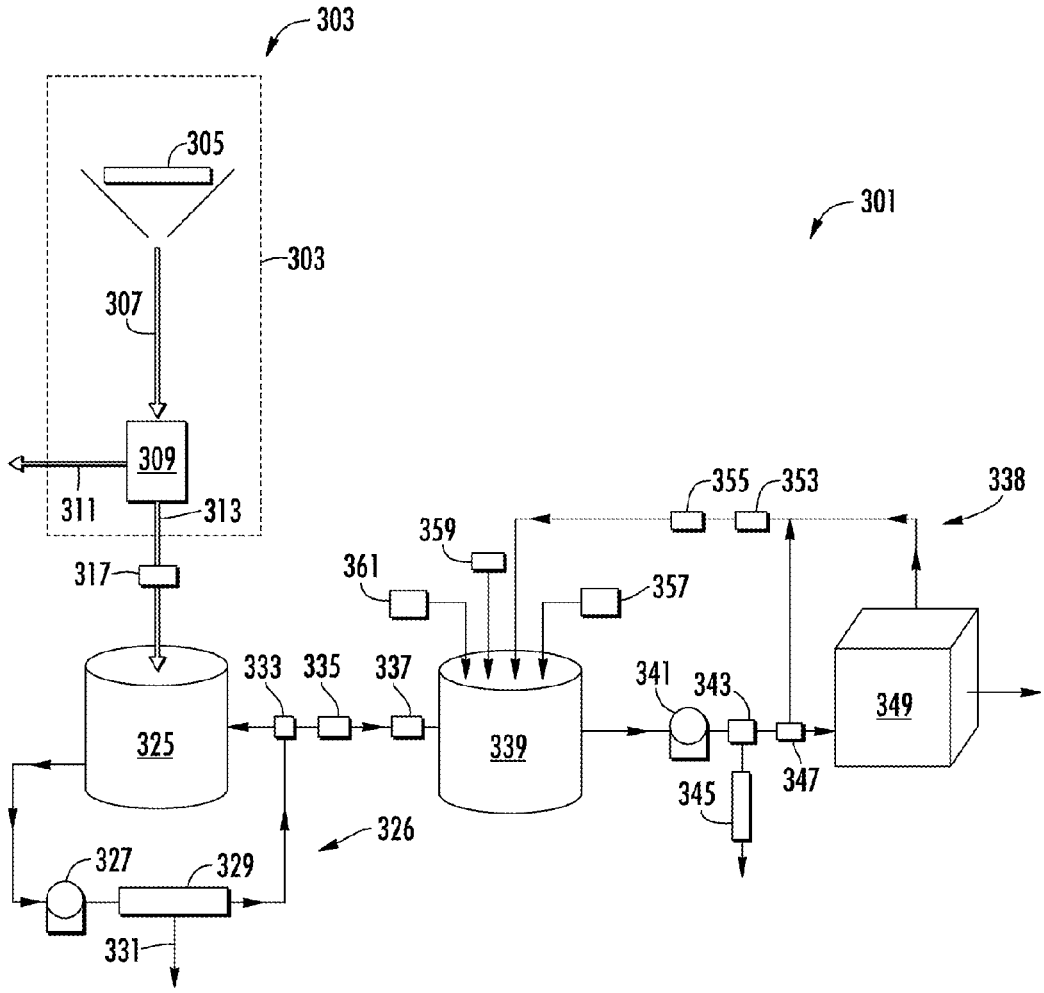
FIG. 3 is an illustration of a slurry recycling process in accordance with the teachings herein.

The water separation and slurry concentration phase of the process described herein may be more fully appreciated with respect to FIG. 3, which depicts a first particular, non-limiting embodiment of a CMP slurry treatment system in accordance with the teachings herein. The slurry recycling system 301 depicted therein is used in conjunction with a CMP process tool 303 which may be, for example, a tool of the type depicted in FIG. 1. The CMP process tool 303 comprises a polishing platen 305 which uses an abrasive slurry to polish a semiconductor substrate. The effluent 307 from the polishing platen 305, which includes used slurry and waste particles, is routed through a diverter valve 309 disposed in the CMP process tool 303. As explained in detail above with reference to FIG. 2, the diverter valve operates to direct slurry recycling waste water 311 out to a wastewater reclaim station or drain, and directs used slurry 313, or wastewater containing higher contents of abrasive particles, to a collection tank 325 by way of a flow meter 317.

The size, shape and dimensions of the collection tank 325 may vary, and will typically be chosen to properly accommodate the volume of slurry collected from the CMP polishing station 303. In one preferred embodiment, however, the collection tank 325 is a 1500 gallon rotationally molded HDPE tank which is available commercially from Snyder Industries, Inc., Lincoln, Nebr.

Figure 4:
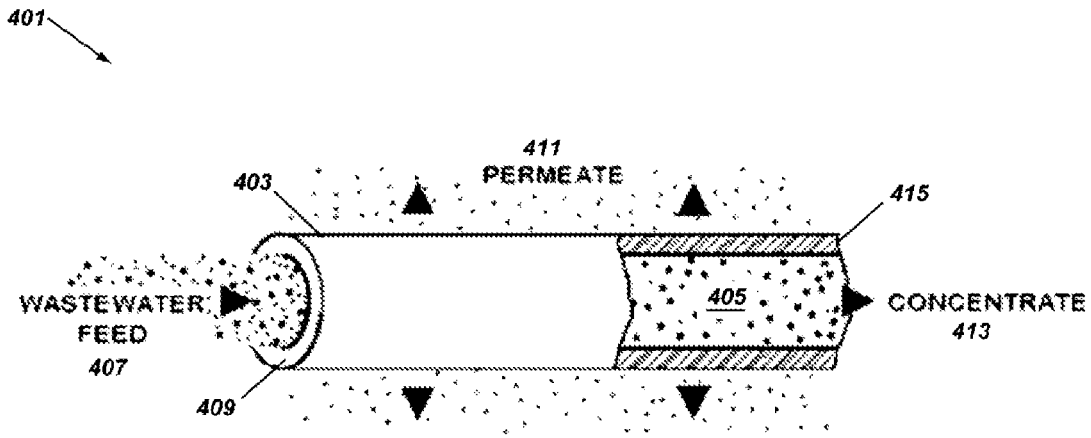
FIG. 4 is an illustration of a tubular ultra-filtration device.
Figure 5:
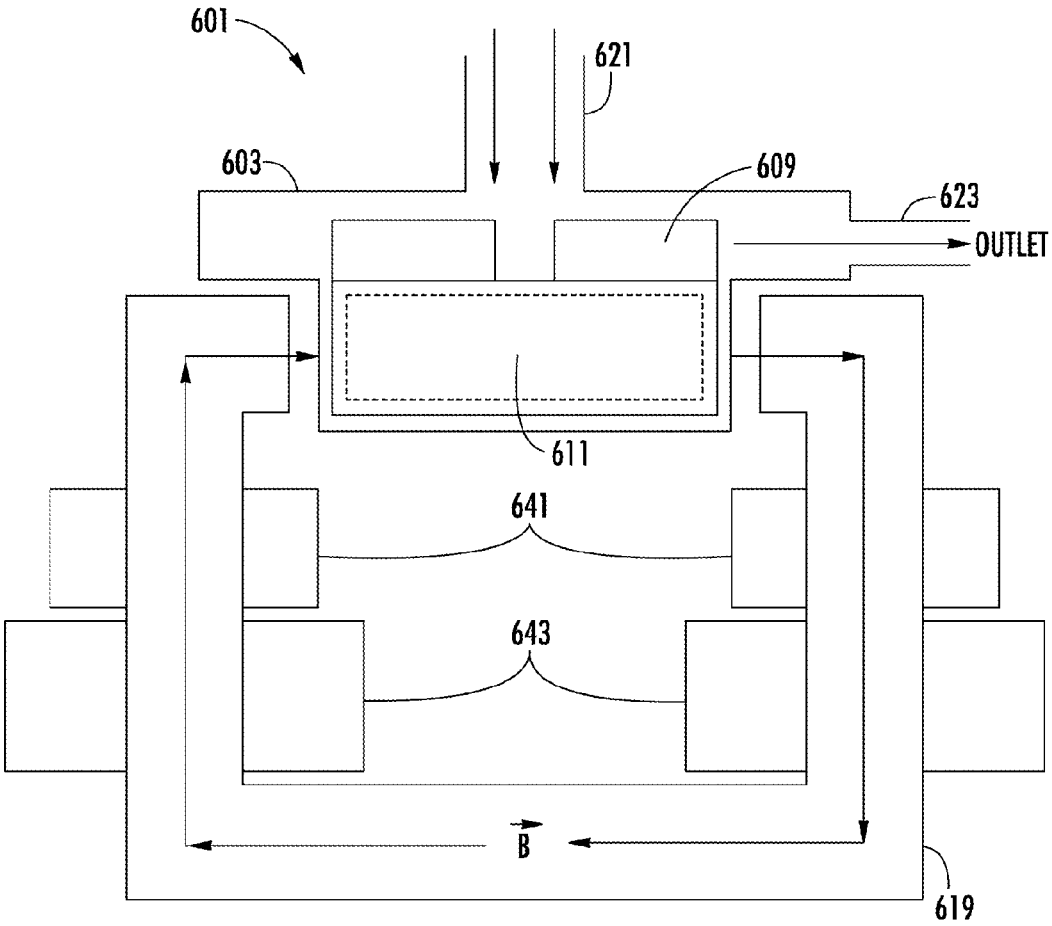
FIG. 5 is an illustration of a bearingless centrifugal pump based on magnetic levitation technology which is suitable for use in the devices and methodologies disclosed herein.
Figure 6:
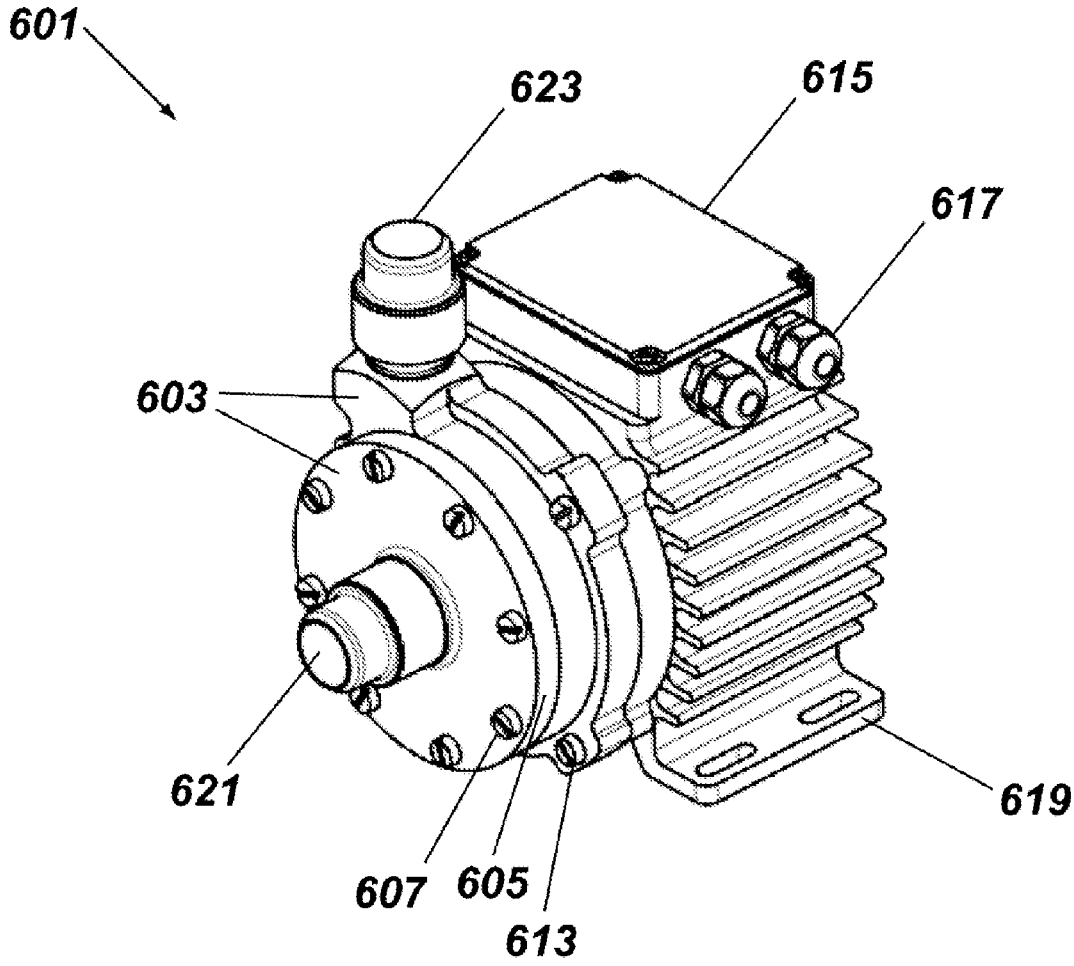
FIG. 6 is an illustration of a bearingless centrifugal pump based on magnetic levitation technology which is suitable for use in the devices and methodologies disclosed herein.
Figure 7:
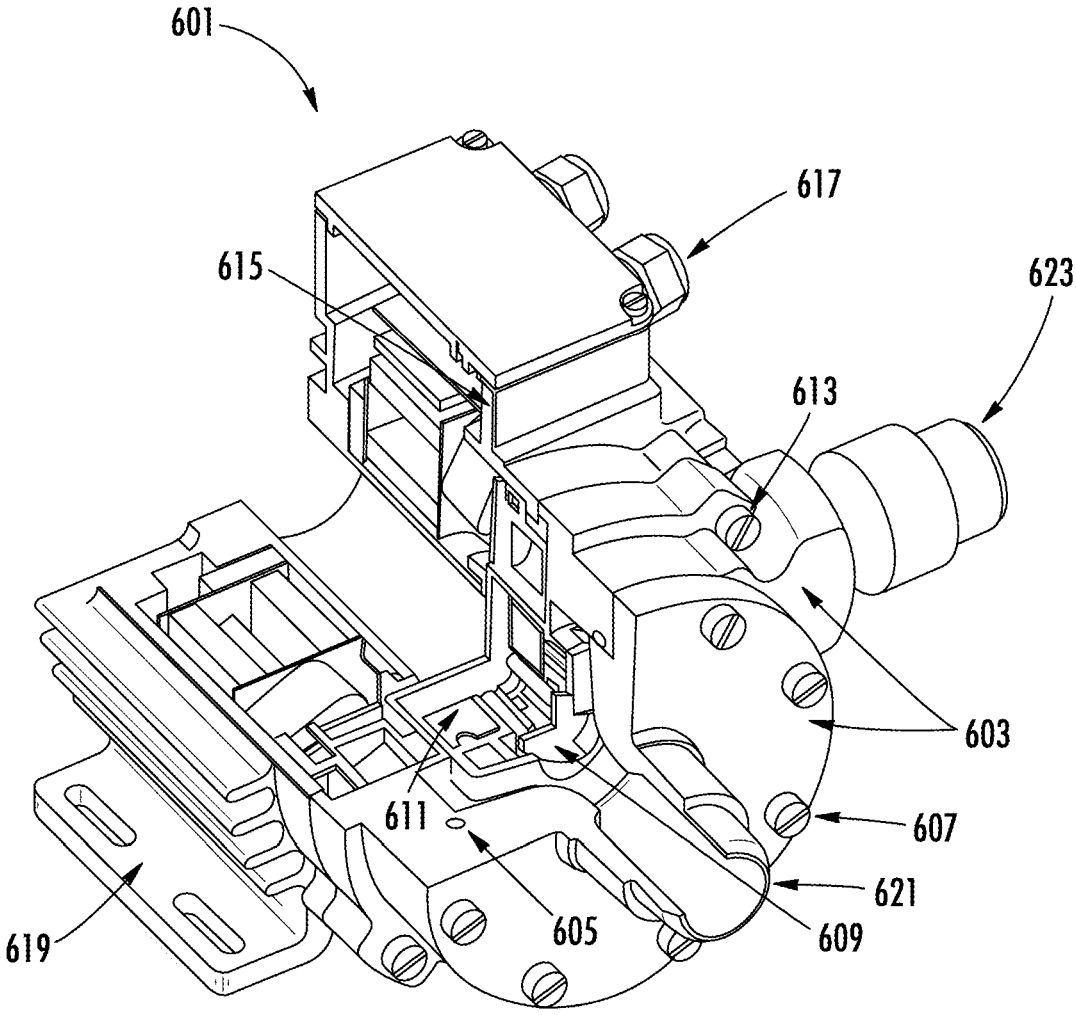
FIG. 7 is an illustration, partially in section, of the centrifugal pump of FIG. 6.
Figure 8:
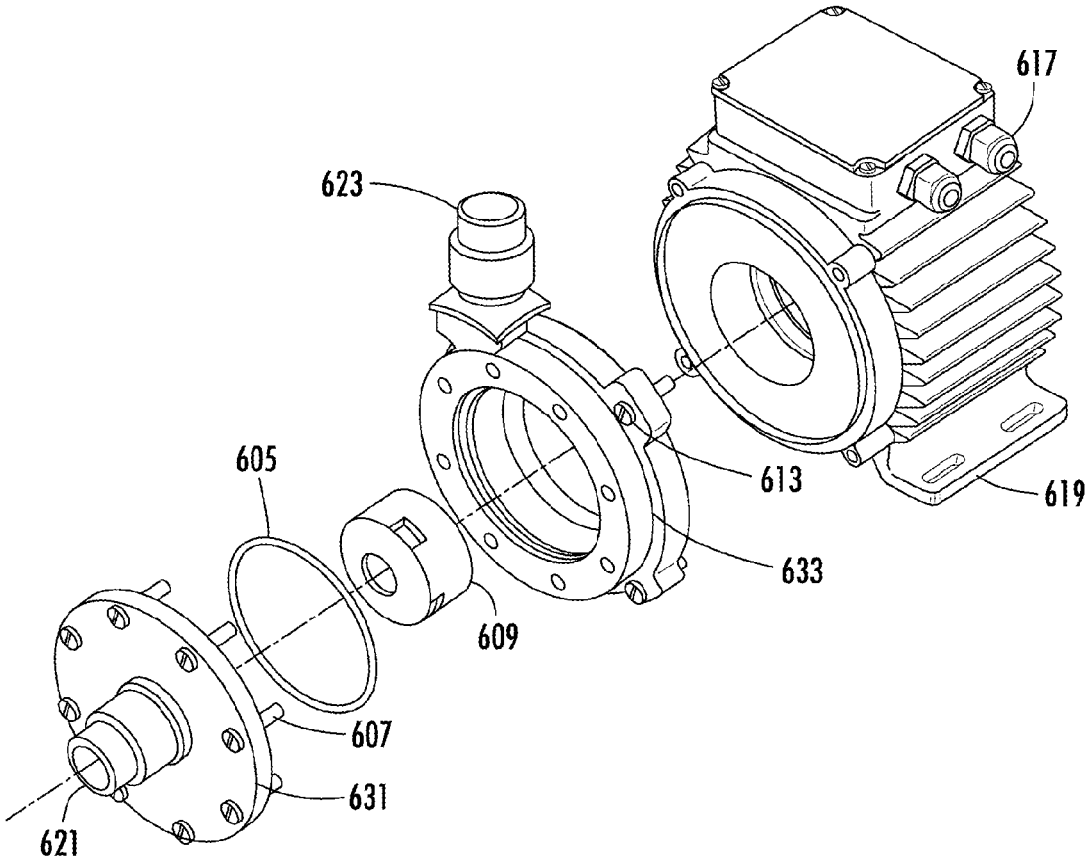
FIG. 8 is a partially exploded view of the centrifugal pump of FIG. 6.

The slurry in the collection tank 325 is then pumped, by way of a delivery pump 327, through a (preferably single-stage) ultra-filtration device 329. The delivery pump 327 may be activated, for example, when the collection tank reaches a certain level, as determined, for example, by an ultrasonic level sensor, by a differential pressure level sensor with accurate constant level sensing to a programmable logic controller (PLC), or by other suitable means as are known to the art. As the slurry passes through the ultra-filtration device 329, a portion of water is removed from the slurry and passes through a conduit 331 to a water reclaiming station or a drain (the operation of the ultra-filtration device is illustrated in FIG. 4). Passage of the slurry through the ultra-filtration device 329 preferably achieves a targeted reduction in slurry volume as measured, for example, by the attainment of a threshold volume or density. In a preferred embodiment, for example, passage of the slurry through the ultra-filtration device 329 increases the percentage of abrasive particles by weight in the slurry from about 0.05-0.08% to about 1-5%.

In some embodiments, if the desired threshold slurry volume or density is not achieved, the slurry may be recycled through a first circuit 326 which includes the collection tank 325, the delivery pump 327, the ultra-filtration device 329, and a three-way valve 333 until the desired volume or density in the slurry is attained or until feed material is required for the second circuit. However, the slurry may be recycled through the first circuit 326 for other purposes as well.

For example, in some embodiments, the slurry may be recycled through the first circuit 326 when or while the downstream portion of the process is not ready to receive slurry from the collection tank 325. This practice is advantageous in that it utilizes this downtime to further reduce the water content of the slurry, thus reducing overall slurry processing time by reducing the number of cycles the slurry must undergo in the remainder of the process. Also, in some embodiments, recirculation may be advantageous in preventing or minimizing particle agglomeration in the slurry (although it is to be understood that, in some systems, recirculation may actually increase the risk of agglomeration). For the purposes of recirculation, the first circuit 326 may be equipped with suitable valves, conduits, mass flow meters, controllers, and other such devices as are known to the art to control the flow of slurry through the first circuit 326 and to monitor the density of the slurry (or differential volume input versus output).

The ultra-filtration device 329 in the first circuit 326 may comprise, for example, one or more ultra-filtration membranes. Such membranes may include, for example, 4"×72" tubular membranes with a 100,000 atomic mass unit (amu) cut-off. Filters of this type are available commercially, for example, from SpinTek Filtration (Los Alamitos, Calif.), and may comprise polyvinylidene difluoride (PVDF). Other suitable ultra-filtration membranes include MEMTEC® ultra-filtration membranes, which are 1"×120" membranes commercially available commercially from Siemens Water Technologies (Shrewsbury, Mass.). Tubular ultra-filtration devices of this type have a wide center channel that allows the filter to handle CMP slurry feed streams with large solids (e.g., agglomerates) without clogging. Moreover, tubular membranes of this type provide high cross-flow velocities, which prevent membrane fouling. Also, membranes of this type offer the ability to perform back-flush cycles, which greatly extends the life of the membranes. Such back-flush cycles may be automated and preprogrammed in the systems and methodologies described herein.

Preferably, multiple tubular membranes are utilized in the ultra-filtration device, and even more preferably (as described in further detail below), racks of tubular membranes are utilized. It is also preferred that redundant filter racks are provided to facilitate filter changing or maintenance without necessitating disruptions to the slurry recycling process flow.

FIG. 4 illustrates the operation of a tubular filter in the processes described herein. As seen therein, the tubular filter 401 depicted comprises a tubular wall 403 which encloses a central passageway 405. The used slurry 407 enters a first end 409 of the tube 401, and travels along the passageway 405. Along the way, some of the water content of the slurry escapes the walls of the tube as a permeate 411, thus yielding a concentrate 413 which exits a second end 415 of the tubular filter 401.

Referring again to FIG. 3, after the slurry is released from the first circuit 326 through the three-way valve 333, it is passed through a source of ultraviolet radiation 335, which serves to kill bacteria, fungi and other living organisms which may be present in the slurry. The presence of such organisms may adversely affect the pH of the slurry, and also introduces potential contaminants into semiconductor substrates processed with the reconstituted slurries.

The slurry is then routed through a large particle filtration device 337. The large particle filtration device 337 removes large particles and agglomerates from the slurry, including any bacterial or fungal mats which may be present. Preferably, a depth wound filter is used for this purpose. Even more preferably, a fiber blown depth wound filter is used for this purpose. Such filters are available commercially, for example, from Entegris, Billerica, Mass. The depth wound filter will typically utilize fiber diameters within the range of 0.2 to 100 uM, depending on customer requirements.

Depth wound filters typically feature a core around which is wound a yarn or matt of filter material. In some embodiments, a core cover may be utilized to prevent fiber migration. The filter material in a depth wound filter is wound in a precise manner to provide depth filtration through hundreds of tapered passageways. Filters of this type offer gradual pressure increase, compared to the sudden increase with surface-type filters. Moreover, progressive dirt removal from surface to core provides high dirt holding capacity. In addition, filters of this type have exceptionally high structural strength and can withstand severe operating and handling conditions. In some embodiments, a double bank of depth filters may be provided for redundancy so that maintenance operations may be performed without interrupting slurry processing.

The core of the depth wound filter may comprise various materials including, but not limited to, polypropylene, stainless steel (including 304 and 316 alloys), nylon, tin, and phenolic resins. The filter media may comprise various materials including, but not limited to, polypropylene (including fibrillated polypropylene), polyester, cotton (including both natural and bleached), rayon, nylon, acrylic fibers, jute, polytetrafluoroethylene (PTF), and polyamide fibers (including aromatic polyamide fibers).

Referring again to FIG. 3, after the slurry is routed through the large particle filtration device 337, it is collected in a process tank 339 for further processing. The size, shape and dimensions of the process tank 339 may vary from one embodiment to the next, and will typically be chosen to properly accommodate the volume of slurry received from the collection tank 325 (which volume will typically be reduced, however, by the aforementioned concentration steps). In one preferred embodiment, the process tank 339 is a 1500 gallon rotationally molded tank which may be obtained commercially from Snyder Industries, Inc., Lincoln, Nebr.

Mixing in the process tank 339 is preferably accomplished through the use of venturi eductors, which have no metallic wetted parts. By contrast, prior art tanks of this type are typically equipped with high shear mixers, which the present inventors have found contribute undesirably to slurry particle degradation. The process tank 339 is also preferably equipped with an ultrasonic level sensor or a differential pressure level sensor with accurate constant level sensing to a programmable logic controller (PLC).

The process tank 339 is preferably further equipped with a spray bar which may be annular in shape and constructed out of a suitable plastic. The spray bar is preferably mounted at the top of the tank and is adapted to provide suitable rinsing of the tank as part of a cleaning cycle. The spray bar may be provided with biased or targeted drilling patterns, where each hole acts as a nozzle and can deliver well-defined jets of water to the internal surfaces of the tank. In some embodiments, spray nozzles may be used in addition to or in place of such holes in order to direct cleaning fluid to specific areas of the tank. The spray bar can also be drilled with targeted spray patterns that concentrate coverage in specific areas of the tank, such as inlet connections and manways. During use, cleaning fluid enters through the inlet connection of the spray bar and leaves via the drilled holes or nozzles. The particular spray pattern and flow rate may vary and may be designed specifically for a given implementation.

Referring again to FIG. 3, the concentrated slurry is then pumped through a second circuit 338 which includes the process tank 339, a process pump 341, a second diverter valve 343, a third diverter valve 347, a filtration unit 349 equipped with ultra-filtration membranes (filtration unit 349 is preferably similar to, or the same as, ultra-filtration device 329, though preferably, filtration unit 349 will contain a greater number of sets or banks than ultra-filtration device 329), a pH meter 353, and a mass flow meter 355. The second circuit 338 also preferably includes a source of virgin slurry 357 (this will typically include a container of concentrated virgin slurry, a valve, a pump, an inlet, and other such means as are known to the art to dispense virgin slurry therefrom), a source of deionized water 359 (this will preferably include an inlet and a valve with a flow meter), and a source of base 361 (the source of base 361 will preferably include a pump, an inlet and other such means as are known to the art to dispense base therefrom, and the base will preferably be selected from the group consisting of KOH, NaOH and $NH_3OH$). One or more of the foregoing elements may be integrated with the process tank 339.

The slurry in the second circuit 338 will typically be recirculated through the filtration unit 349 a sufficient number of times until the slurry has attained the required concentration and volume. Used slurry may be added from first circuit 326 as needed to arrive at an appropriate batch volume. If slurry concentration is overshot, water will preferably be added in order to reach desired end point. Third diverter valve 347 may be used to bypass the filtration unit 349 while adjustments are being made to the pH, while virgin slurry or deionized water is being added, during maintenance of the filtration unit, and at other times as may be desirable.

After the slurry has been concentrated to a desired level, the volume of the slurry is determined (if necessary), and a portion of virgin slurry may be added to achieve recipe parameters. The addition of virgin slurry serves to keep the reformulated slurry fresh by ensuring that a certain percentage of the slurry particles are new, thereby compensating for particle degradation and other such factors. A ratio of virgin slurry to reclaim slurry will typically be set by the process recipe and may be, for example, within the range of 1:6 to 1:4. The pH may then be measured as described above and a pH adjusting agent (typically a base) may be added as necessary to bring the pH to within a desired pH range (preferably 10.9-11.2 pH units).

The slurry recycling system 301 is preferably managed by a closed loop control system. Preferably, during processing, the concentration and mass of the reconstituted slurry is continuously measured by the mass flow meter 355 as the slurry comes out of the filtration unit 349. After a sufficient number of cycles through the filtration unit 349, the density of the slurry will hit the targeted number, and the process controller determines that the slurry batch is sufficiently concentrated and ready for reconstitution with virgin slurry and base. At this point, diverter valve 347 isolates UF membranes 349 from the second circuit 338 until reconstitution of the slurry is completed, at which point the second diverter valve 343 directs the reformulated slurry out of the second circuit 338 and into a day tank (not shown) for storage.

Preferably, a large particle filter 345 is provided between the second diverter valve 343 and the day tank to remove any large particles that may have formed during reformulation. An automated report is then preferably created and approved as per an established protocol, and the finished slurry is delivered to the chemical distribution system of the CMP facility as needed. The tanks and tubes in the slurry recycling system 301 will then preferably be rinsed and drained. In some parts of the tool, an automated cleaning process may be initiated that will circulate a cleaning solution (preferably a solution of a suitable base) in order to clean the tool.

Various devices and methodologies may be utilized as the pH meter 353 in the systems described herein. Thus, for example, pH may be measured using either a standard glass electrode or an ISFET (ion-selective field effect transistor) style electrode. It is desirable to monitor pH in these devices and methodologies because pH provides an indication of the aggressiveness of the slurry in a CMP process. In particular, a low pH in a CMP process tends to drive down removal rates and increase defectivity numbers in polishing trials. Base will typically be added in measurable quantities to bring the pH to 10.9-11.2 pH units. At this pH, acceptable removal and defectivity values are typically observed.

Filtration unit 349 is equipped with ultra-filtration membranes, and is preferably similar to, or the same as, filtration unit 329. As noted above, however, filtration unit 349 will preferably contain a greater number of sets or banks than ultra-filtration device 329. Preferably, a sufficient number of ultra-filtration banks or sets are used in both filtration units 329 and 349 to create redundancy and to permit the use of smaller pumps. Since the ultra-filtration banks are typically deployed in parallel, the mass flow meter 355 and pH meter 353 may be integrated into the common return plumbing from these units. Here, it is to be noted that there will typically be a pump assigned to each UF filter bank.

With respect to filtration units 329 and 349, it is to be noted that, under the nomenclature used to describe these devices, a plurality (X) of tubes in series constitute a set, multiple sets in parallel constitute a bank, and multiple banks in parallel constitute a system. Mathematically, if Z is the number of banks and Y is the number of sets in a bank, then the number of tubes per bank is XY. Hence, the total number of tubes T in the filtration unit is given by EQUATION 1 below:

$$T=Z*XY \quad \text{(EQUATION 1)}$$

The mass flow meter 355 may be used to measure the specific gravity, and preferably does so to at last four significant figures. From that measurement, the percent concentration of abrasive particles may typically be calculated to an accuracy of ±0.1%. For example, if the slurry is a silica slurry, then the % silica by weight ($w_{silica}$) may be calculated from EQUATION 2 below:

$$w_{silica}=\ln(p_{Si})*150.43+2.42 \quad \text{(EQUATION 2)}$$

where $p_{Si}$ is the density of silica (this value does not vary significantly with manufacturing technique). EQUATION 2 is applicable to both colloidal silica and to fumed silica in an aqueous suspension.

In a typical run, the total volume for a finished batch will be about 300-700 gal, and about 15-25% of the total finished slurry will be virgin slurry. At a starting concentration of 1% and a finished concentration of 11.5%, an approximate volume of 3450-8050 gallons of used slurry will be required. Of course, these values may vary significantly from one implementation to another. All setpoints that determine completion of the batch are adjustable within reasonable parameters.

The delivery pump 327 and the process pump 341 are preferably bearingless centrifugal pumps which are based on magnetic levitation technology. In such pumps, a pump rotor is suspended and driven by the magnetic field of a motor/bearing stator through the wall of the pump housing without mechanical contact. A signal processor-based electronic control unit allows precise regulation of the speed, pressure or flow rate. Pumps of this type are commercially available, for example, from Levitronix, Waltham, Mass.

A preferred embodiment of the type of pump which may be used as the delivery pump 327 or process pump 349 is shown in greater detail in FIGS. 5-8. In this particular, non-limiting embodiment, the delivery pump 601 is equipped with a pump casing 603 (lid and bottom) made out of polytetrafluoroethylene (PTFE), a static sealing O-ring 605 made out of KALREZ® perfluoroelastomer, a first set of screws 607 for the pump casing which are made out of polyvinylidene difluoride (PVDF), an impeller 609 made out of perfluoroalkoxy (PFA) perfluoropolymers, a rotor magnet 611 made out of a rare earth material such as NdFe, a second set of screws 613 for the pump/motor mounting, a flat gasket 615 for the motor housing (this gasket comprises fluorocarbon materials such as VITON® fluorocarbon rubbers), a cable bushing 617 (the cable bushing 617 comprises PVDF, while the cable jacket comprises fluorinated ethylene-polypropylene (FEP)), and a motor housing 619. The motor housing 619 comprises an ethylene tetrafluoroethylene (ETFE) coating, waterproof (IP-67) coils, and an electromagnetic circuit potted with an epoxy compound (UL94 V0).

The systems, devices and methodologies disclosed herein may be used to reclaim and recycle oxide slurries that are typically made from suspended particles, base and water. The suspended particles will most typically be either colloidal silica or fumed silica, though one skilled in the art will appreciate that these systems, devices and methodologies are applicable to a variety of other slurry types such as, for example, tungsten slurries.

It is noted that silica can have a diameter of 75 nm to 150 nm, with fumed silica being larger then colloidal silica in most cases. The devices and methodologies described herein receive used slurry from a CMP tool and process the slurry into a product that can be used again in the CMP process or tool.

In some embodiments, the processes described herein may be completely automated, except for filter changes and the performance of other types of system maintenance. Such automation may include the collection of data on parameters that are of interest to the user. The reportable data that is created will typically enable the user to track the process and create suitable process controls.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A method for reformulating a chemical mechanical planarization (CMP) slurry for use in conjunction with a CMP tool having an active cycle during which the tool is being used to planarize a substrate, and a rinse cycle during which the tool is being rinsed, the method comprising:

receiving a feed stream from the CMP tool, at least a portion of the feed stream comprising a used slurry which includes abrasive particles disposed in a liquid medium;

during at least a portion of the rinse cycle, sending the feedstream received from the CMP tool to a first location; and during at least a portion of the active cycle, sending the feedstream received from the CMP tool to a second location where the feedstream undergoes processing to reformulate the slurry;

wherein the processing at the second location comprises increasing the concentration of particles in the feed stream by removing a portion of the liquid medium therefrom with an ultra-filtration device, thereby obtaining a concentrated feedstream, wherein the untra-filtration device has an inlet and an outlet, and wherein the ultra-filtration device extracts water from the used slurry as the used slurry passes from the inlet to the outlet.

2. The method of claim 1, wherein the feedstream is also sent to the second location during a portion of the rinse cycle.

3. The method of claim 1, wherein the processing at the second location comprises:

increasing the concentration of particles in the feed stream by removing a portion of the liquid medium therefrom with an ultra-filtration device, thereby obtaining a concentrated feedstream.

4. The method of claim 3, wherein the processing at the second location comprises:

adjusting the pH of the concentrated feed stream.

5. The method of claim 4, wherein adjusting the pH of the concentrated feed stream involves adding a base to the concentrated feed stream.

6. The method of claim 3, wherein increasing the concentration of particles in the feed stream includes circulating the feed stream a plurality of times through a first circuit that includes the ultra-filtration device.

7. The method of claim 6, wherein the feed stream is circulated through the first circuit until the feed stream reaches a predetermined specific gravity.

8. The method of claim 6, wherein the first circuit includes a mass flow meter.

9. The method of claim 1, wherein the first location is a wastewater treatment system.

10. The method of claim 1, wherein the first location is a drain.

11. The method of claim 1, wherein the first and second locations are distinct.

12. The method of claim 1, wherein the processing at the second location includes routing the feedstream through first and second circuits, and wherein the first circuit comprises a first holding tank, a first pump, and a first ultra-filtration device.

13. The method of claim 12, wherein the second circuit comprises a second holding tank, a second pump, and a second ultra-filtration device.

14. The method of claim 13, wherein the feedstream is recirculated through the first circuit until the second circuit is ready to receive the feedstream.

15. The method of claim 13, wherein the second circuit further comprises a pH meter.

16. The method of claim 13, wherein the second circuit further comprises a mass flow meter.

17. The method of claim 13, wherein the second circuit further comprises a source of virgin slurry.

18. The method of claim 13, wherein the second circuit further comprises a source of deionized water.

19. A method for recycling CMP slurry, comprising:

using a slurry in a chemical mechanical planarization (CMP) process at a semiconductor processing facility, said slurry comprising abrasive particles disposed in a liquid medium; and recirculating the used slurry through an ultra-filtration device at the semiconductor processing facility until the slurry attains a predetermined specific gravity, thereby producing a concentrated slurry;

wherein the ultra-filtration device has an inlet and an outlet, and wherein the ultra-filtration device extracts water from the used slurry as the used slurry passes from the inlet to the outlet.

20. A method for reformulating a chemical mechanical planarization (CMP) slurry, comprising:

providing a feed stream from a CMP tool, at least a portion of said feed stream comprising abrasive particles disposed in a liquid medium;

sending the feedstream to a first location when the concentration of abrasive particles in the feedstream is below a threshold level k; and sending the feedstream to a second location when the concentration of abrasive particles in the feedstream is above the threshold level k, where the feedstream undergoes processing at the second location to reformulate the slurry;

wherein the processing at the second location comprises increasing the concentration of particles in the feed stream by removing a portion of the liquid medium therefrom with an ultra-filtration device, thereby obtaining a concentrated feedstream.

21. The method of claim 20, wherein the processing at the second location comprises:

adjusting the pH of the concentrated feed stream.

22. The method of claim 21, wherein adjusting the pH of the concentrated feed stream involves adding a base to the concentrated feed stream.

23. The method of claim 20, wherein increasing the concentration of particles in the feed stream includes recirculating the feed stream through a first circuit that includes the ultra-filtration device.

24. The method of claim 23, wherein the feed stream is recirculated through the first circuit until the feed stream reaches a predetermined specific gravity.

25. The method of claim 24, wherein the first circuit includes a mass flow meter.

26. The method of claim 20, wherein said CMP particles are used in a CMP process prior to being provided in the feed stream.

27. The method of claim 20, wherein the first location is a wastewater treatment system.

28. The method of claim 19, further comprising adding virgin slurry to the used slurry after the predetermined specific gravity has been attained.

29. The method of claim 19, wherein the ultra-filtration device is a tubular ultra-filtration membrane.

30. A method for recycling CMP slurry, comprising:

using a slurry in a chemical mechanical planarization (CMP) process at a semiconductor processing facility, said slurry comprising abrasive particles disposed in a liquid medium; and recirculating the used slurry through an ultra-filtration device at the semiconductor processing facility until the slurry attains a predetermined specific gravity, thereby producing a concentrated slurry;

wherein the untra-filtration device has an inlet and an outlet, and wherein the ultra-filtration device extracts water from the used slurry as the used slurry passes from the inlet to the outlet.

31. The method of claim 30, wherein the used slurry is recirculated through a circuit which includes the ultra-filtration device and a mass flow meter, and wherein the mass flow meter is used to determine whether the specific gravity of the slurry has attained the predetermined required specific gravity.

32. The method of claim 30, further comprising:

adjusting the pH of the concentrated slurry by adding a base to the slurry.

33. The method of claim 30, further comprising:

adding virgin slurry to the concentrated slurry.

34. The method of claim 33, wherein the amount of virgin slurry added to the concentrated slurry is about 15% to about 25% of the total amount of slurry.

35. A method for reformulating a chemical mechanical planarization (CMP) slurry, comprising:

providing a feed stream from a CMP tool, at least a portion of said feed stream comprising abrasive particles disposed in a liquid medium;

sending the feedstream to a first location during a first time interval, where the feedstream undergoes processing at the first location to reformulate the slurry; and sending the feedstream to a second location during a second time interval;

wherein the processing at the first location comprises increasing the concentration of particles in the feed stream by removing a portion of the liquid medium therefrom with an ultra-filtration device, thereby obtaining a concentrated feedstream.

36. The method of claim 35, wherein the CMP tool conducts chemical mechanical planarization of at least one semiconductor substrate over a time interval $T_1=\{t_0, t_1\}$, and conducts a rinsing cycle over a time interval $T_2=\{t_2, t_3\}$.

37. The method of claim 36, wherein the feedstream is sent to the first location during the time interval $t_0+a$ to $t_1+b$, wherein a, b>0.

38. The method of claim 37, wherein the feedstream is sent to the second location at all other times.

39. The method of claim 37, wherein the feedstream is sent to the second location during the time interval $t_2+c$ to $t_3+d$, wherein c, d>0.

* * * * *